US007567211B2

(12) United States Patent
Hsu et al.

(10) Patent No.: US 7,567,211 B2
(45) Date of Patent: Jul. 28, 2009

(54) ANTENNA

(75) Inventors: Cheng-Hsuan Hsu, Hsin-Tien (TW); Chia-Wen Hsu, Hsin-Tien (TW); Tsung-Wen Chiu, Hsin-Tien (TW); Fu-Ren Hsiao, Hsin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 12/028,966

(22) Filed: Feb. 11, 2008

(65) Prior Publication Data

US 2008/0198085 A1 Aug. 21, 2008

(30) Foreign Application Priority Data

Feb. 15, 2007 (TW) ..... 96105848 A

(51) Int. Cl.
*H01Q 1/38* (2006.01)

(52) U.S. Cl. ..... 343/700 MS; 343/795; 343/846

(58) Field of Classification Search ..... 343/700 MS, 343/795, 846
See application file for complete search history.

(56) References Cited

U.S. PATENT DOCUMENTS

| | | | | |
|---|---|---|---|---|
| 6,741,219 | B2 | 5/2004 | Shor | |
| 6,747,605 | B2 * | 6/2004 | Lebaric et al. | 343/795 |
| 7,224,315 | B2 * | 5/2007 | Tsai et al. | 343/700 MS |
| 2004/0201525 | A1 * | 10/2004 | Bateman et al. | 343/700 MS |

* cited by examiner

*Primary Examiner*—James Cho
(74) *Attorney, Agent, or Firm*—Rabin & Berdo, P.C.

(57) ABSTRACT

An antenna is formed integrally into one piece and has a ground plane, a feeding strip and two pairs of radiating patches. The feeding strip is connected integrally to the ground plane. The pairs of the radiating patches are formed symmetrically and integrally on the feeding strip. The antenna formed integrally into one piece simplifies the manufacture of the antenna lowers the manufacturing cost of the antenna.

11 Claims, 9 Drawing Sheets

——— Vertical Component

- - - - - Horizontal Component

ANTENNA

BACKGROUND OF THE INVENTION

1. Field of the Invention

The present invention relates to an antenna, and more particularly to an antenna formed integrally into one piece.

2. Description of Related Art

With reference to FIG. 1, U.S. Pat. No. 6,741,219 discloses a parallel-feed planar high-frequency antenna (1) comprising a substrate and two dipole conducting strips. The substrate is made of dielectric material. The dipole conducting strips are mounted on opposite sides of the substrate. Each dipole conducting strip has a feed structure (10, 12), a feed point (24, 34), a plurality of feed lines (26, 28, 30, 32, 36, 38, 40, 42) and a plurality of half-wavelength dipoles (2*a*, 4*a*, 6*a*, 8*a*, 2*b*, 4*b*, 6*b*, 8*b*). The feed point (24, 34) is located on the feed structure (10, 12). The feed lines (26, 28, 30, 32, 36, 38, 40, 42) are connected to the feed point (24, 34). The half-wavelength dipoles (2*a*, 4*a*, 6*a*, 8*a*, 2*b*, 4*b*, 6*b*, 8*b*) are connected respectively to the feed lines (26, 28, 30, 32, 36, 38, 40, 42).

However, the structure of the antenna (1) is complicated. The dipole conducting strips are separated from each other instead of being formed into a single piece and are mounted respectively on the opposites sides of the substrate by adhesive so that fabricating the antenna (1) is time-wasting and lowers the production rate of the antenna (1). Furthermore, the substrate between the dipole conducting strips reduces gains of the antenna.

To overcome the shortcomings, the present invention provides an antenna to mitigate or obviate the aforementioned problems.

SUMMARY OF THE INVENTION

The main objective of the invention is to provide an antenna formed integrally into one piece.

An antenna is formed integrally into one piece and has a ground plane, a feeding strip and two pairs of radiating patches. The feeding strip is connected integrally to the ground plane. The pairs of the radiating patches are formed symmetrically and integrally on the feeding strip. The antenna formed integrally into one piece simplifies the manufacture of the antenna lowers the manufacturing cost of the antenna.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
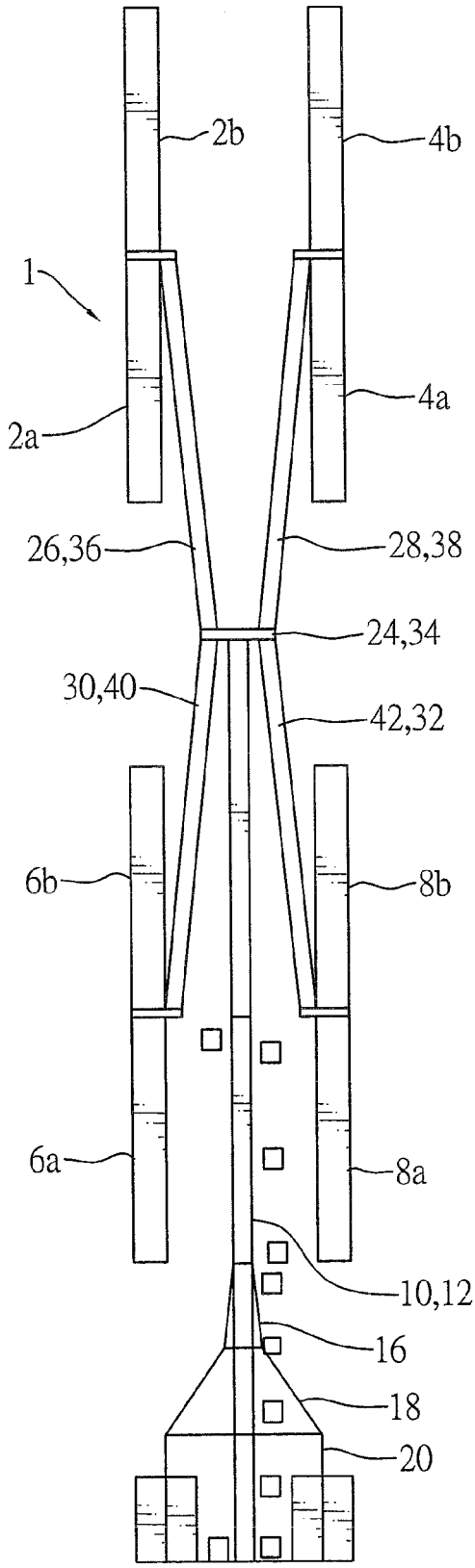
FIG.1 PRIOR ART
FIG. 1 is a top view of a conventional antenna in accordance with the present invention.
Figure 2:
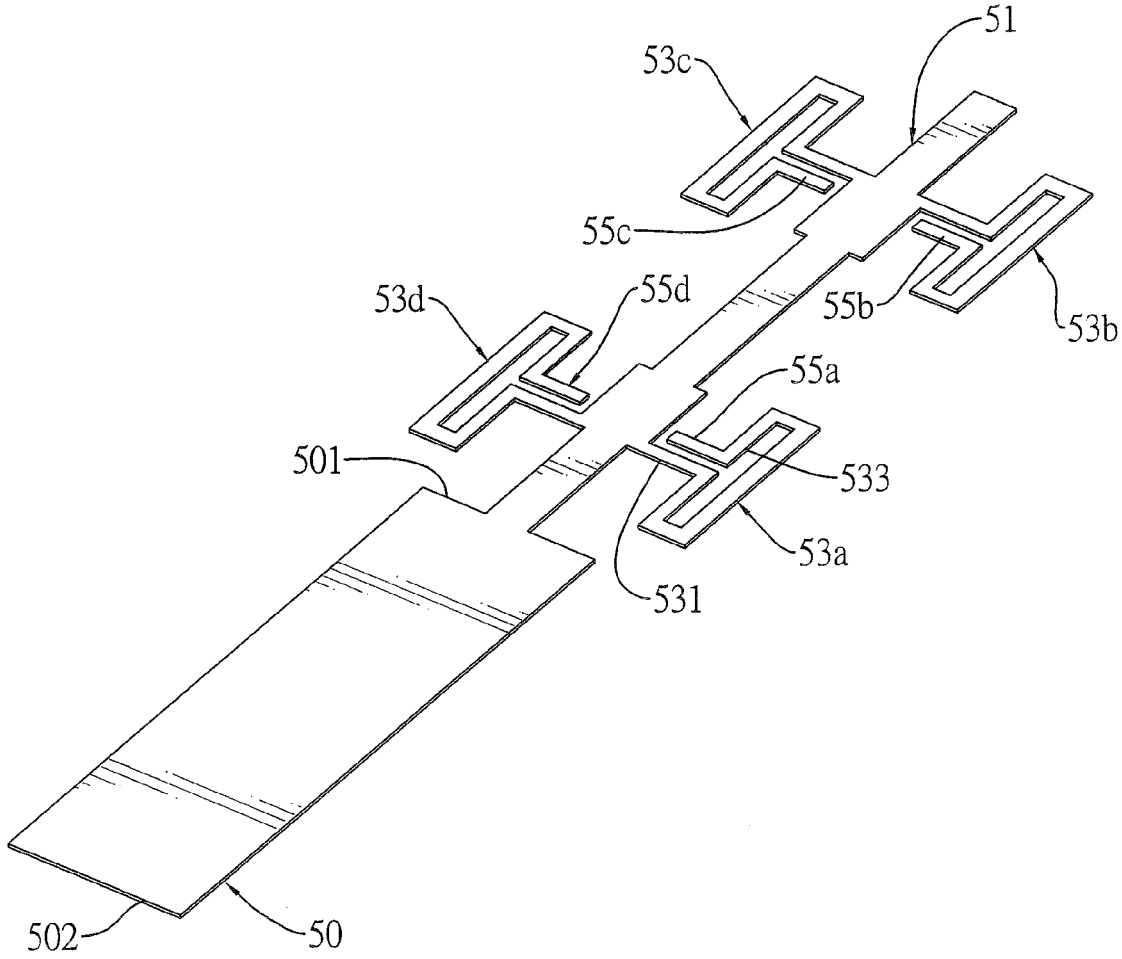
FIG. 2 is a perspective view of a semi-finished product of a first embodiment of an antenna in accordance with present invention.
Figure 3:
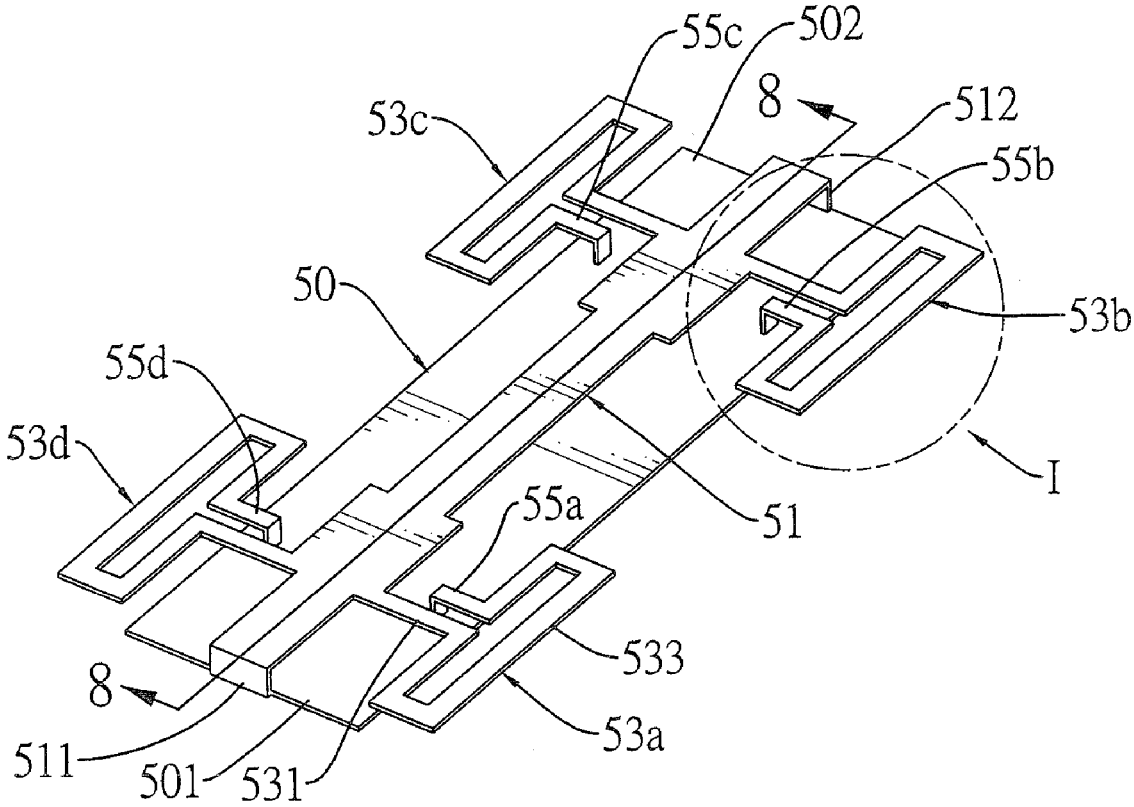
FIG. 3 is a perspective view of the antenna formed from the semi-finished product in FIG. 1.

With reference to FIGS. 2 and 3, a first embodiment of the antenna in accordance with the present invention may be formed from a single sheet metal or two sheet metals. The single sheet metal is stamped and/or cut by a processing machine to form a planar semi-finished product of the antenna, as shown in FIG. 2. Then, the planar semi-finished product is bent to form the antenna, as shown in FIG. 3. Alternatively, the sheet metals are stamped, cut and bent respectively and then soldered together to form the antenna.

The antenna from the single sheet metal is formed integrally into a single piece and comprises a ground plane (50), a feeding strip (51) and two pairs of radiating patches (53*a*, 53*b*, 53*c*, 53*d*) and may further have four grounding members (55*a*, 55*b*, 55*c*, 55*d*).

The ground plane (50) is flat and rectangular and has a connecting end (501), a distal end (502), a top surface and two opposite sides. The distal end (502) is opposite to the connecting end (501). The length and the width of the ground plane (50) are about 120 mm and about 8 mm.

The feeding strip (51) is formed integrally on and protrudes from the connecting end (501) of the ground plane (50) and has two end sections (511, 512) and an intermediate section. On section end (511) is formed on and protrudes integrally on the connecting end (501) of the ground plane (50). The other end section (502) is connected integrally to the distal end (502) of the ground plane (50) by a soldering process. After the soldering process, the end sections (511, 512) are formed integrally on and perpendicularly protrude respectively from the connecting end (501) and the distal end (501) of the ground plane (50). The intermediate section is formed perpendicularly between and held by the end sections (511, 512) to suspend over the top surface of the ground plane (50) and has two opposite sides. The length, width and thickness of the feeding strip (51) are about 121 mm, about 2.6 mm and about 5 mm.

The pairs of the radiating patches (53*a*, 53*b*, 53*c*, 53*d*) are formed symmetrically and integrally on the intermediate section of the feeding strip (5 1). The radiating patches (53*a*, 53*b*, 53*c*, 53*d*) of each pair are symmetrical relative to the feeding strip (51), are formed integrally on and transversely protrude respectively from the sides of the intermediate section of the feeding strip (51) and suspend over the top surface of the ground plane (50). Each radiating patch (53*a*, 53*b*, 53*c*, 53*d*) is rectangular and has a connection section (531) and a main section (533).

The connection section (531) is longitudinal, is formed on and protrudes transversely from one side of the intermediate section of the feeding strip (51). The length of the connection section (531) is about 4 mm. The width of the connection (531) is about 1.5 mm. The length of the connection (531) is about 4 mm. An interval between the main section The main section (533) is C-shaped and rectangular and is formed on and protrudes from the connection section (531) and has a distal end. The distal end of the main section (533) is at an interval from the connection section (531). The interval is at most 2 mm. The width of the main section (533) is about 1.5 mm. The length and width a rectangle based on the main section (533) are about 36 mm and 5 mm.

Figure 5:
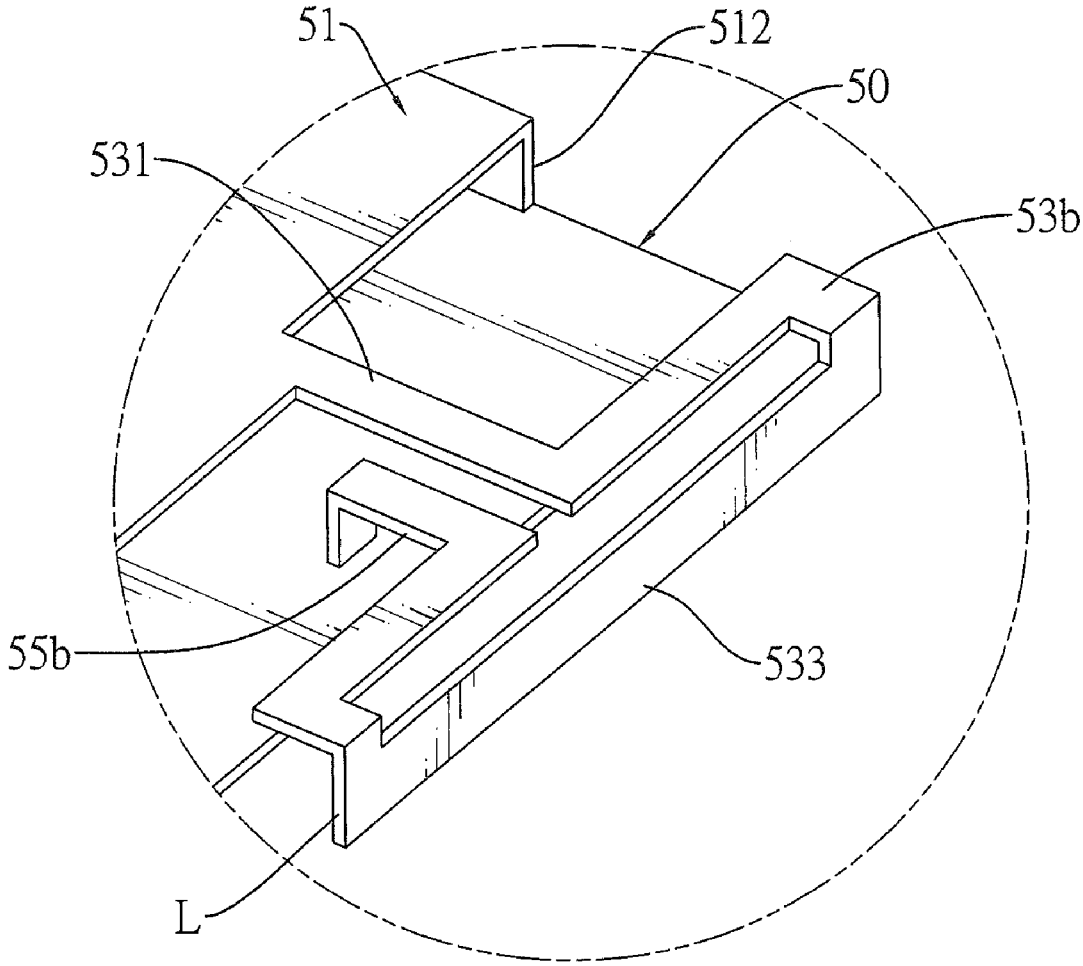
FIG. 5 is a partially enlarged perspective view of the antenna in FIG. 3 based on circle I with the main section of a variant of the radiating patch having an L-shaped cross section.

With further reference to FIG. 5, in a variant of the radiating patch (53*a*, 53*b*, 53*c*, 53*d*), the main section (533) may be bent to have an L-shaped cross section (L), a lateral portion and an upright portion. The lateral portion is parallel to the top surface of the ground plane (50). The upright portion protrudes down from the lateral portion and is perpendicular to the top surface of the ground plane (50). The bent mains section (533) makes the radiating patches (53*a*, 53*b*, 53*c*, 53*d*) more compact so that the antenna may be assembled easily in a casing of a wireless product.

The grounding members (55*a*, 55*b*, 55*c*, 55*d*) are formed integrally on and protrude respectively from the distal ends of the main sections (533) of the radiating patches (53*a*, 53*b*, 53*c*, 53*d*) and each grounding member (55*a*, 55*b*, 55*c*, 55*d*) has an end portion. The length of each grounding member (55*a*, 55*b*, 55*c*, 55*d*) is about 4 mm. The end portion is formed on and protrudes perpendicularly from the grounding member (55*a*, 55*b*, 55*c*, 55*d*) and is connected integrally to the top surface of the ground plane (50) by solder or adhesive.

A total extended length of each radiating patch (53*a*, 53*b*, 53*c*, 53*d*) with a corresponding grounding member (55*a*, 55*b*, 55*c*, 55*d*) is about 88 mm which similar to a wavelength of 86 mm of the Wimax 3.5 GHz operating system.

Figure 4A:
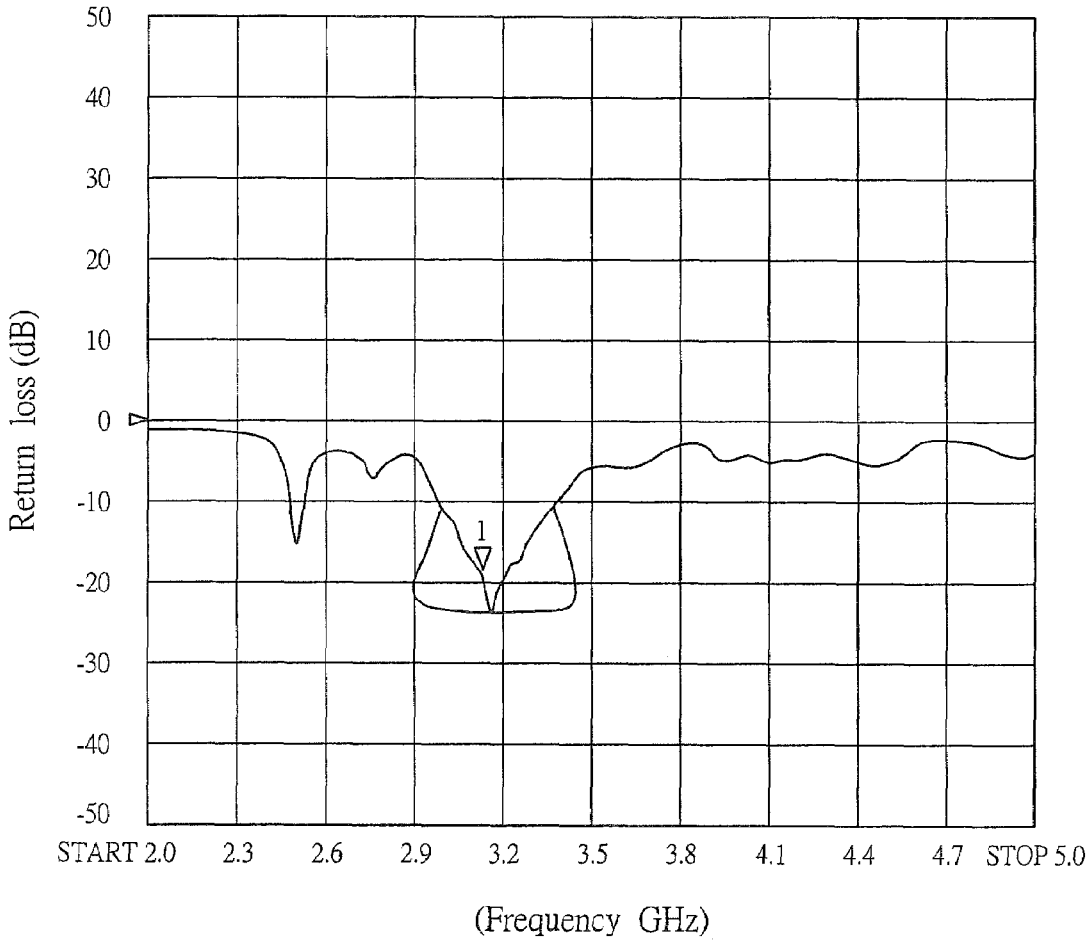
FIG. 4A is a diagram of return loss vs. frequency of the antenna in FIG. 3.
Figure 4B:
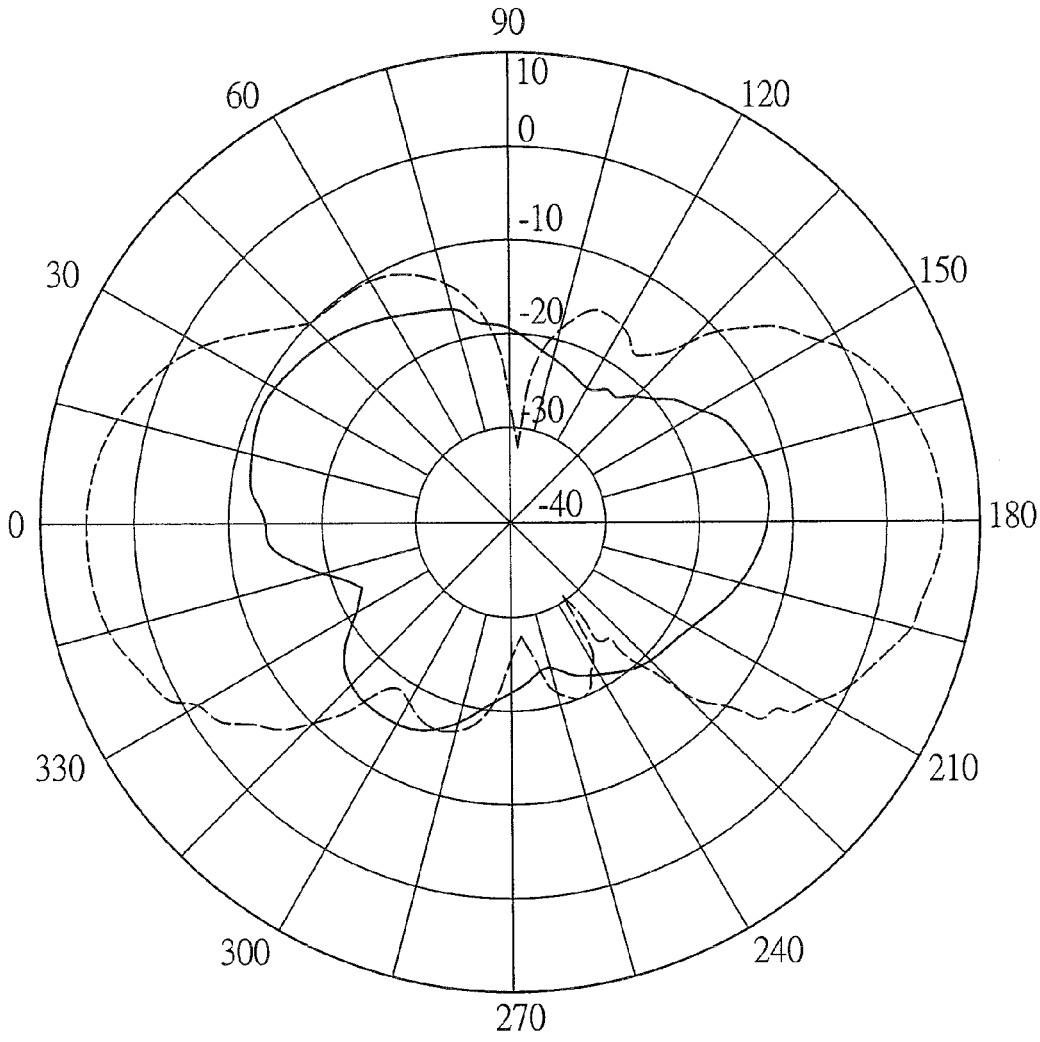
FIG. 4B is a diagram of the radiation pattern of the antenna in FIG. 3 in the elevation plane.

With further reference to FIGS. 4A and 4B, an operating bandwidth of the antenna contains a frequency extent from 3.3 GHz to 3.8 GHz and therefore includes the Wimax 3.5 GHz system bandwidth, as shown in FIG. 4A. Radiation patterns of the antenna extending along the feeding strip (51) has a maximum signal to noise (SNR) value of 5.5 dB, as shown in FIG. 4B. Therefore, the gains of the antenna are high.

When two sheet metals are employed to manufacture the antenna, one sheet metal is processed to form the ground plane (50) and the other one is processed to form the feeding strip (51), the radiating patches (53*a*, 53*b*, 53*c*, 53*d*) and the grounding members (55*a*, 55*b*, 55*c*, 55*d*). Then, the feeding strip (51) and the grounding members (55*a*, 55*b*, 55*c*, 55*d*) are soldered on the ground plane (50) to integrally form the feeding strip (51) on the ground plane (50) therefore to complete an integrally formed antenna.

The first embodiment of the antenna has six connecting and supporting points between the ground plane (50) and the feeding strip (51) and the radiating patches (53*a*, 53*b*, 53*c*, 53*d*) so that the feeding strip (51) and the radiating patches (53*a*, 53*b*, 53*c*, 53*d*) are held securely on the ground plane (50). Furthermore, when signals are transmitted along the feeding strip (51) for a path being a quarter of an operating wavelength, the short circuit property of the antenna changes into the open circuit property and causes a broken circuit to interrupt the signals. Therefore, a shortest path along the feeding strip (51) from a first joint point between the feeding strip (51) and the connection section (531) of each radiating patch (53*a*, 53*b*, 53*c*, 53*d*) to a second joint point between the ground plane (50) and one end section (511, 512) of the feeding strip (51) is set to be a quarter of the operating wavelength. The shortest path is about 21.5 mm. Moreover, the feeding strip (51) with the end sections (511, 512) connected integrally to the ground plane (50) prevents the current along antenna from being interrupted and improves the radiation of the antenna.

Figure 6:
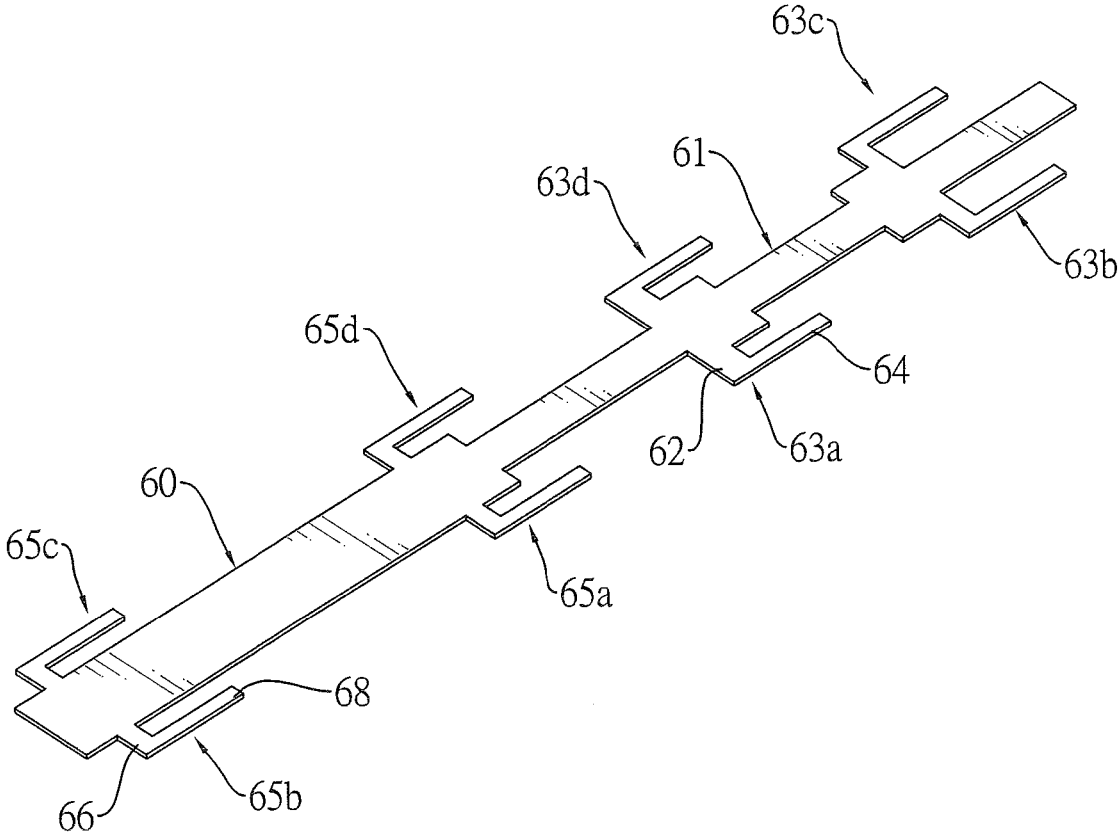
FIG. 6 is a perspective view of a semi-finished product of a second embodiment of an antenna in accordance with present invention.
Figure 7:
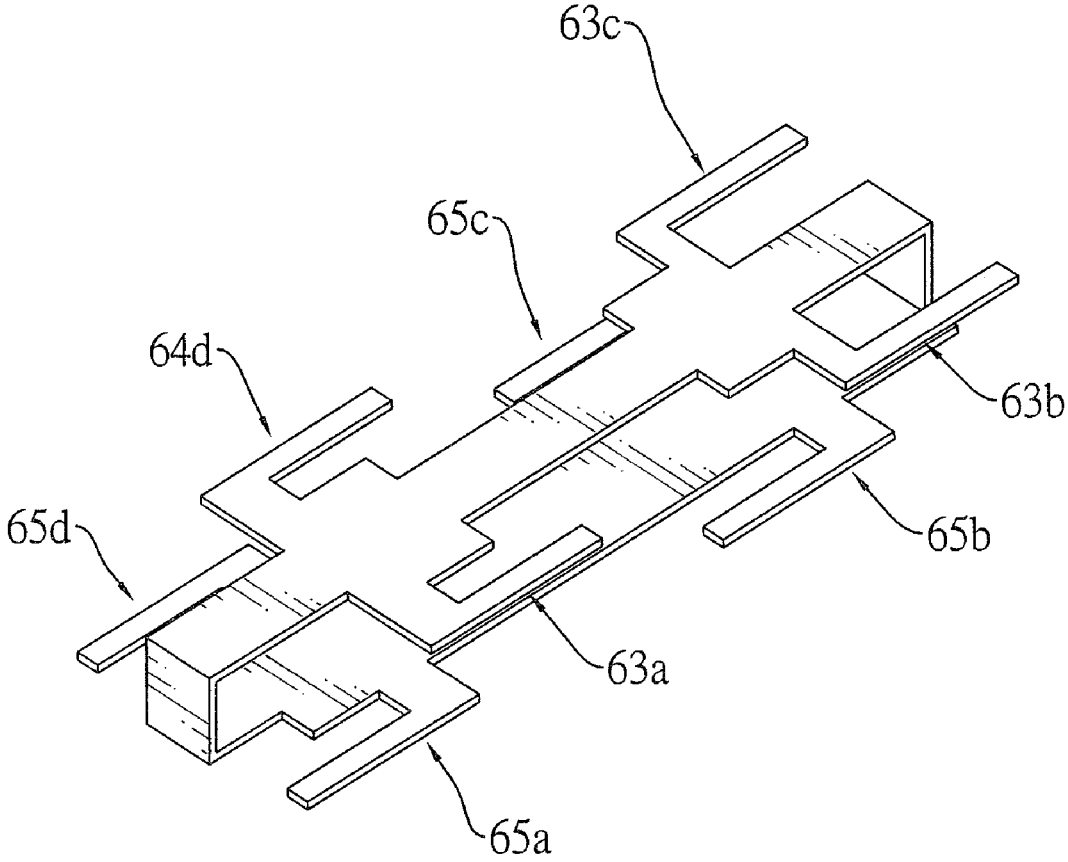
FIG. 7 is a perspective view of the antenna formed from the semi-finished product in FIG. 6.

With further reference to FIGS. 6 and 7, a second embodiment of an antenna in accordance with the present invention is similar to the first embodiment and has a ground plane (60), a feeding strip (61) and two first pairs and two second pairs of radiating patches (63*a*, 63*b*, 63*c*, 63*d*, 65*a*, 65*b*, 65*c*, 65*d*).

The first pairs of the radiating patches (63*a*, 63*b*, 63*c*, 63*d*) are symmetrical relative to the feeding strip (61) and are formed integrally on the feeding strip (61). The second pairs of the radiating patches (65*a*, 65*b*, 65*c*, 65*d*) are formed integrally on the ground plane (60). The radiating patches (63, 6*b*, 63*c*, 63*d*) of each second pair on the ground plane (60) are symmetrical relative to the ground plane (60), are formed on and transversely protrude respectively from the sides of the ground plane (60). Each radiating patch (63, 6*b*, 63*c*, 63*d*, 65*a*, 65*b*, 65*c*, 65*d*) is L-shaped and has a transverse section (62, 66) and a longitudinal section (64, 68). The transverse section (62, 66) is formed on and protrudes from one side of the intermediate section of the feeding strip (61) or from one side of the ground plane (60). The longitudinal section (64, 68) is formed on and protrudes perpendicularly from the transverse section (62, 66). The longitudinal sections (64) of the first pairs extend along a first direction and the longitudinal sections (68) of the second pairs extend along a second direction being opposite to the first direction.

The second embodiment of the antenna has two connecting and supporting points between the ground plane (60) and the feeding strip (61) so that the feeding strip (61) and the radiating patches (63*a*, 63*b*, 63*c*, 63*d*) on the feeding strip (61) are held securely on the ground plane (50). Furthermore, when signals are transmitted along the feeding strip (61) for a path being a quarter of an operating wavelength, the short circuit property of the antenna changes into the open circuit property and causes a broken circuit to interrupt the signals. Therefore, a shortest path along the feeding strip (51) from a first joint point between the feeding strip (61) and the transverse section (62) of each radiating patch (63*a*, 63*b*, 63*c*, 63*d*) of each first pair to a second joint point between the ground plane (60) and one end section of the feeding strip (61) is set to be a quarter of the operating wavelength. Moreover, the feeding strip (61) with the end sections connected integrally to the ground plane (60) prevents the current along antenna from being interrupted and improves the radiation of the antenna.

Figure 8:
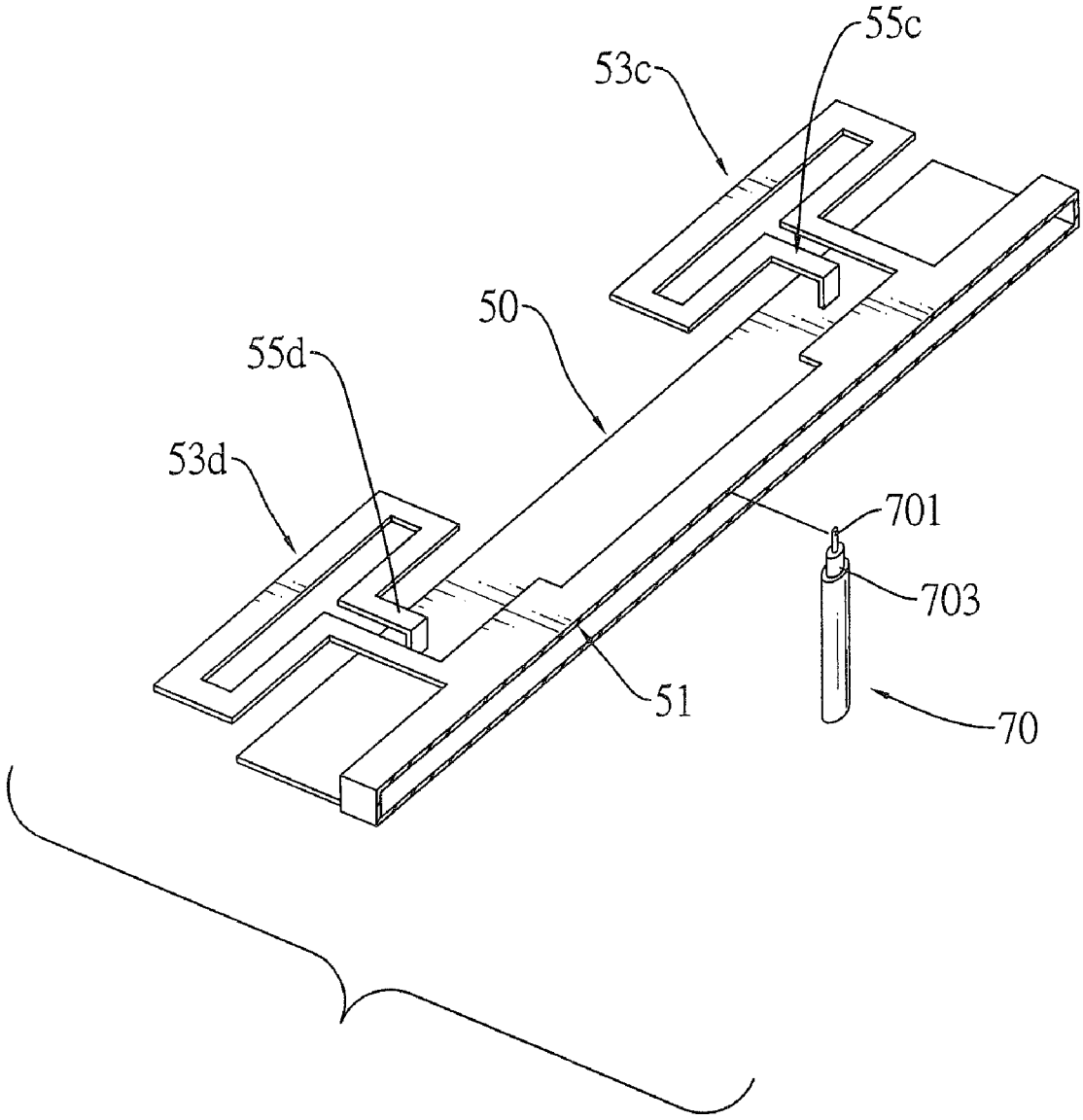
FIG. 8 is an exploded perspective view in partial section of the antenna in FIG. 3 along line 8-8 with a feeding cable connected to the antenna.

With further reference to FIG. 8, a feeding cable (70) is mounted on the first embodiment of the antenna and has a covering, a positive signal wire (701) and a negative signal wire (703). The positive signal wire (701) is connected to a central section of the feeding strip (51). The negative signal wire (703) is connected to the ground plane (50). The way of mounting the feeding cable (70) to the second embodiment of the antenna is similar to that of mounting the feeding cable (70) to the first embodiment as aforementioned.

Because the antenna is formed integrally into one piece, manufacturing the antenna is simple and the manufacturing cost of the antenna is lowered. Furthermore, the antenna is configured without a dielectric substrate structure so that gains of the antenna is improved.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An antenna comprising:

a ground plane having a connecting end;

a distal end being opposite to the connecting end;

a top surface; and two opposite sides;

a feeding strip formed integrally on the ground plane and having two end sections formed integrally on and protruding respectively from the feeding strip and integrally connected respectively to and standing perpendicularly on the connecting end and the distal end of the ground plane; and an intermediate section formed between and held by the end sections to suspend over the top surface of the ground plane and having two opposite sides; and two pairs of radiating patches formed integrally on the intermediate section of the feeding strip, the radiating patches of each pair being symmetrical relative to the feeding strip, formed integrally on and transversely protruding respectively from the sides of the intermediate section of the feeding strip and suspending over the top surface of the ground plane.

2. The antenna as claimed in claim 1 further comprising four grounding members formed integrally on and protruding respectively from the radiating patches and each grounding member having an end portion formed on and protruding perpendicularly from the grounding member and connected perpendicularly to the top surface of the ground plane.

3. The antenna as claimed in claim 2, wherein:

each radiating patch is rectangular and has a connection section being longitudinal, formed on and protruding transversely from one side of the intermediate section of the feeding strip; and a main section being formed on and protruding from the connection section and having a distal end at an interval from the connection section; and the grounding members protrude respectively from the distal ends of the main sections of the radiating patches.

4. The antenna as claimed in claim 3, wherein the main section of each radiating patch is bent to have an L-shaped cross section;

a lateral portion being parallel to the top surface of the ground plane; and an upright portion protruding down from the lateral portion and being perpendicular to the top surface of the ground plane.

5. The antenna as claimed in claim 1, wherein:

the pairs of the radiating patches are first pairs; and two second pairs of radiating are formed integrally on the ground plane, and the radiating patches of each second pair are symmetrical relative to the ground plane, are formed on and transversely protrude respectively from the sides of the ground plane;

each radiating patch of each first pair is L-shaped and has a transverse section formed on and protrudes from one side of the intermediate section of the feeding strip; and a longitudinal section formed on and protruding perpendicularly from the transverse section; and each radiating patch of each second pair is L-shaped and has a transverse section formed on and protrudes from one side of the ground plane; and a longitudinal section formed on and protruding perpendicularly from the transverse section; and the longitudinal sections of the first pairs extend along a first direction and the longitudinal sections of the second pairs extend along a second direction being opposite to the first direction.

6. The antenna as claimed in claim 4, wherein the antenna is formed from a sheet metal.

7. The antenna as claimed in claim 5, wherein the antenna is formed from a sheet metal.

8. The antenna as claimed in claim 4, wherein the antenna is formed from two sheet metals, the ground metal is formed from one of the sheet metal, and the feeding strip, the radiating patches and the grounding members are formed from the other sheet metal.

9. The antenna as claimed in claim 5, wherein the antenna is formed from two sheet metals, the ground metal is formed from one of the sheet metal, and the feeding strip, the radiating patches and the grounding members are formed from the other sheet metal.

10. The antenna as claimed in claim 4, wherein a shortest path along the feeding strip from a first joint point between the feeding strip and one radiating patch to a second joint point between the ground plane and one end section of the feeding strip is a quarter of an operating wavelength.

11. The antenna as claimed in claim 5, wherein a shortest path along the feeding strip from a first joint point between the feeding strip and one radiating patch of each first pair to a second joint point between the ground plane and the feeding strip is a quarter of the operating wavelength.

* * * * *